US011439193B2

(12) United States Patent
Gucciardi

(10) Patent No.: US 11,439,193 B2
(45) Date of Patent: Sep. 13, 2022

(54) VENTILATED HAIR EXTENSION WEFTS

(71) Applicant: Tammy Gucciardi, Coral springs, FL (US)

(72) Inventor: Tammy Gucciardi, Coral springs, FL (US)

( * ) Notice: Subject to any disclaimer, the term of this patent is extended or adjusted under 35 U.S.C. 154(b) by 466 days.

(21) Appl. No.: 15/879,394

(22) Filed: Jan. 24, 2018

(65) Prior Publication Data

US 2018/0146732 A1 May 31, 2018

Related U.S. Application Data

(60) Provisional application No. 62/450,282, filed on Jan. 25, 2017.

(51) Int. Cl.
*A41G 5/00* (2006.01)

(52) U.S. Cl.
CPC ..... *A41G 5/0073* (2013.01); *A41G 5/0046* (2013.01); *A41G 5/0066* (2013.01); *A41G 5/0086* (2013.01)

(58) Field of Classification Search
CPC .... A41G 5/0026; A41G 5/004; A41G 5/0053; A41G 5/0073; A41G 3/0008; A41G 3/0041; A41G 3/005
USPC ..... 132/201, 53, 54
See application file for complete search history.

(56) References Cited

U.S. PATENT DOCUMENTS 3,678,942 A * 7/1972 Abbott ..... A41G 3/00 132/201
3,830,245 A * 8/1974 Abbott ..... A41G 3/0041 132/201
2002/0185146 A1* 12/2002 Gold ..... B29C 66/8223 132/201
2005/0252518 A1* 11/2005 Salinas ..... A41G 5/004 132/201
2007/0125399 A1* 6/2007 Guliker ..... A41G 5/004 132/201
2007/0157941 A1* 7/2007 Awad ..... A41G 5/0026 132/53

(Continued)

FOREIGN PATENT DOCUMENTS

GB 240720 A * 10/1925 ..... A41G 5/004

OTHER PUBLICATIONS

Locks and Bonds, Silicone-Lined Aluminum Rings, 2016, https://locksandbonds.com/product-category/micro-rings-beads/silicone-aluminum/ (Year: 2016).*

*Primary Examiner* — Tatiana L Nobrega
*Assistant Examiner* — Sarah Woodhouse
(74) *Attorney, Agent, or Firm* — RC Trademark Company

(57) ABSTRACT

A method of integrating a hair extension weft on a human scalp is disclosed. The hair extension weft includes a polyurethane strip enclosing a plurality of meshes arranged in a longitudinal direction of the strip. Each mesh is configured to have a plurality of contiguous hairs attached in a transverse orientation. The hair extension weft includes several gaps formed between the plurality of meshes in the longitudinal direction. Each gap is configured to receive a plurality of hairs from the human scalp. Upon clipping the hair extension weft to the human scalp, the plurality of hairs is pulled through each gap with a needle shaped tool placed under the each gap of the hair extension weft. A microbead is clamped to the plurality of hairs pulled through the each gap, to anchor the hair extension weft to the human scalp.

4 Claims, 8 Drawing Sheets

(56) References Cited

U.S. PATENT DOCUMENTS

| | | | | |
|---|---|---|---|---|
| 2008/0295856 | A1* | 12/2008 | Kallabat | A41G 5/0066 132/201 |
| 2009/0014023 | A1* | 1/2009 | Waters | A41G 5/0066 132/201 |
| 2009/0056730 | A1* | 3/2009 | Wilson | A61F 2/10 132/53 |
| 2010/0065078 | A1* | 3/2010 | Reece | A41G 5/006 132/54 |
| 2011/0197908 | A1* | 8/2011 | Waters | A41G 5/0086 132/201 |
| 2012/0085362 | A1* | 4/2012 | Costa | A41G 5/006 132/201 |
| 2012/0260933 | A1* | 10/2012 | Ourique | A41G 5/006 132/201 |
| 2015/0013710 | A1* | 1/2015 | Buzaglo | A41G 5/0093 132/201 |
| 2016/0120252 | A1* | 5/2016 | Kenna | A41G 5/0073 132/54 |
| 2017/0208885 | A1* | 7/2017 | Alex | A41G 5/0093 |

* cited by examiner

VENTILATED HAIR EXTENSION WEFTS

BACKGROUND

Technical Field

The embodiments herein relate generally to the field of hair cosmetology. Particularly, the embodiments herein relates to apparatus and methods used for hair extensions. More particularly, the embodiments herein relates to hair extension wefts and methods of integrating hair extension wefts to a human scalp.

Description of the Related Art

The hair extensions are used to enhance a beauty of people having scanty hair. In some cases, the hair extensions supplement natural hairs of people suffering from hair loss. Typically the hair extensions are provided in a form of wefts where multiple strands of natural human hair or synthetic hair are woven together on a base structure. The base structure along with a multiple attached strands of hair are referred to as hair extension wefts. Such hair extension wefts are anchored to a human scalp by various techniques to improve an overall volume of hair.

Some of the techniques of anchoring the hair extension wefts involve a use of micro rings or microbeads and the natural hairs of existing on the human scalp, to clamp the wefts close to the human scalp. However, such anchored hair extension wefts using the natural hairs of a person, tend to slip due to growth of the natural hair. Further, a structure of the existing hair extension wefts tend to prevent a free flow of air and water thereby making a cleaning of hair difficult. The cleaning products such as hair oils, shampoos and other hair products sometimes tend to get stuck between such wefts, thereby leading to a growth of bacteria, and molds. As the abovementioned products continue to get stuck over a period of time, the wefts get heavier and apply a strain over the natural hairs existing on the human scalp, thereby leading to a hair breakage and further a hair loss.

Hence there is a need for an improved hair extension weft and a method of anchoring the hair extension weft to enable an efficient cleaning of the hair extension weft, after an anchoring of the hair extension weft on a human scalp once. Further, there is a need for a method of anchoring the hair extension weft to reduce slipping of the anchored hair extension weft during a growth of natural hairs on the human scalp.

The above-mentioned shortcomings, disadvantages, and problems are addressed herein and which will be understood by reading and studying the following specification.

OBJECTIVES OF THE EMBODIMENTS HEREIN

A primary object of the embodiments herein is to provide a ventilated hair extension weft that enables a free flow of air and water through the hair extensions.

Another object of the embodiments herein is to provide an improved hair extension weft to facilitate efficient cleaning of the hair extension weft after anchoring on a human scalp.

Yet another object of the embodiments herein is to develop an improved hair extension weft provided with an additional support through a plurality of microbeads to avoid a slippage of the hair extension weft due to a result of hair growth, when the extension weft is anchored to a human scalp using microbeads in order.

Yet another object of the embodiments herein is to develop an improved hair extension weft provided with an additional support to the hair extension weft at a plurality of locations on the human scalp that is subjected to abrasive use.

Yet another object of the embodiments herein is to provide an anchored hair extension weft with a higher longevity.

These and other objects and advantages of the embodiments herein will become readily apparent from the following detailed description taken in conjunction with the accompanying drawings.

SUMMARY

The embodiments herein disclose a hair extension weft that includes a polyurethane strip encasing a plurality of meshes that are arranged along a longitudinal direction of the strip. Each mesh is configured to have a plurality of contiguous hairs attached in a transverse orientation. Further, the haft extension weft includes a plurality of apertures arranged between the pluralities of meshes provided along the longitudinal direction of the strip. Each aperture is configured to receive a plurality of hafts clamped to a surface. The plurality of hairs is clamped using a plurality of microbeads to anchor the hair extension weft to the surface.

According to an embodiment herein, the surface is a human scalp of a person, and the plurality of hairs is a plurality of natural hairs existing on the human scalp.

According to an embodiment herein, the plurality of contiguous hairs is attached to the each mesh by a ventilation process or by hand knotting process.

According to an embodiment herein, the plurality of contiguous hairs comprises a natural human hair or synthetic hair.

According to an embodiment herein, the plurality of microbeads is arranged along the longitudinal direction of the strip. Each microbead comprises a hole configured to receive the plurality of hairs extending from the each gap aperture. Each microbead is clamped onto the plurality of hairs. Each microbead is clamped by using a plyer device.

According to an embodiment herein, the hair extension weft further includes a plurality of anchors arranged along the longitudinal direction at a plurality of strategic locations. Wherein an anchor is configured to receive a plurality of hairs extending from a microbead and is arranged below the microbead onto the plurality of hairs extending from the microbead to provide support to the microbead and the plurality of hairs. The anchors are heated with a heating device.

According to an embodiment herein, the plurality of strategic locations include a plurality of areas on the surface and wherein the plurality of areas are subjected to abrasive use.

According to an embodiment herein, a strategic location is a side of a human scalp. The strategic location is one of an area existing on a side of a human scalp and an area at the back of the human scalp that is subjected to a greater styling than an area existing in a remaining portion of the human scalp.

According to an embodiment herein, the plurality of microbeads is made of an aluminum and is covered with a layer of silicone material, and the silicone lining is provided at the inner surface of the central hole in the microbead.

According to an embodiment herein, the plurality of anchors is any one of a plurality of plastic shrinkie tubes, a plurality of keratin beads and a plurality of utip keratin pieces. According to an embodiment herein, the plurality of anchors is made of keratin and melt.

According to an embodiment herein, the anchor is clamped by a process of heating with a heating device.

According to an embodiment herein, the plurality of meshes is two, and wherein each mesh is of any rectangular shape of any size. According to an embodiment herein, each mesh is a rectangular mesh. According to an embodiment herein, each mesh has a width of one inch and a length of 5, 10 and 12 inches. Each mesh is provided at a preset distance from a longitudinal edge of the polyurethane strip, and from a transverse edge of the polyurethane strip. Each mesh is separated from the adjacent mesh by a preset distance.

According to an embodiment herein, a method of integrating a hair extension weft on a human scalp is disclosed. The method includes clipping the hair extension weft to the human scalp, and wherein the hair extension weft includes a polyurethane strip encasing a plurality of meshes arranged in a longitudinal direction of the strip. Each mesh is configured to have a plurality of contiguous hairs attached in a transverse orientation, and a plurality of apertures is arranged in the longitudinal direction between the plurality of meshes. Each aperture is configured to receive a plurality of hairs from the human scalp. Further, the method includes pulling the plurality of human hairs through each aperture by using a needle placed under each aperture of the hair extension weft, and clamping a micro bead to the plurality of hairs pulled through each aperture to anchor the hair extension weft to the human scalp.

According to an embodiment herein, the microbead is clamped onto the plurality of hairs by using a plyer device.

According to an embodiment herein, the method further includes clamping an anchor onto a plurality of hairs extending from a microbead located at a strategic location along the longitudinal direction of the hair extension weft to provide support to the microbead and the plurality of hairs.

According to an embodiment herein, the strategic location is an area on the human scalp that is subjected to abrasive use.

According to an embodiment herein, the plurality of microbeads is made of an aluminum material and is covered with a layer of silicone material and the silicone lining is provided at the inner surface of the central hole in the microbead.

According to an embodiment herein, the anchor is any one of a plurality of plastic shrinkie tubes, a plurality of keratin beads and a plurality of utip keratin pieces.

According to an embodiment herein, the plurality of contiguous hairs is attached to the each mesh by any one of a ventilation process and hand knotting process.

According to an embodiment herein, the plurality of contiguous hairs comprises any one of a natural human hair and synthetic hair.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of an illustration and not of a limitation. Many changes and modifications may be made within the scope of the embodiments herein without departing from the spirit thereof, and the embodiments herein include all such modifications.

BRIEF DESCRIPTION OF THE DRAWINGS

The other objects, features, and advantages will be apparent to those skilled in the art from the following description of the preferred embodiment herein and the accompanying drawings in which.

Figure 1:
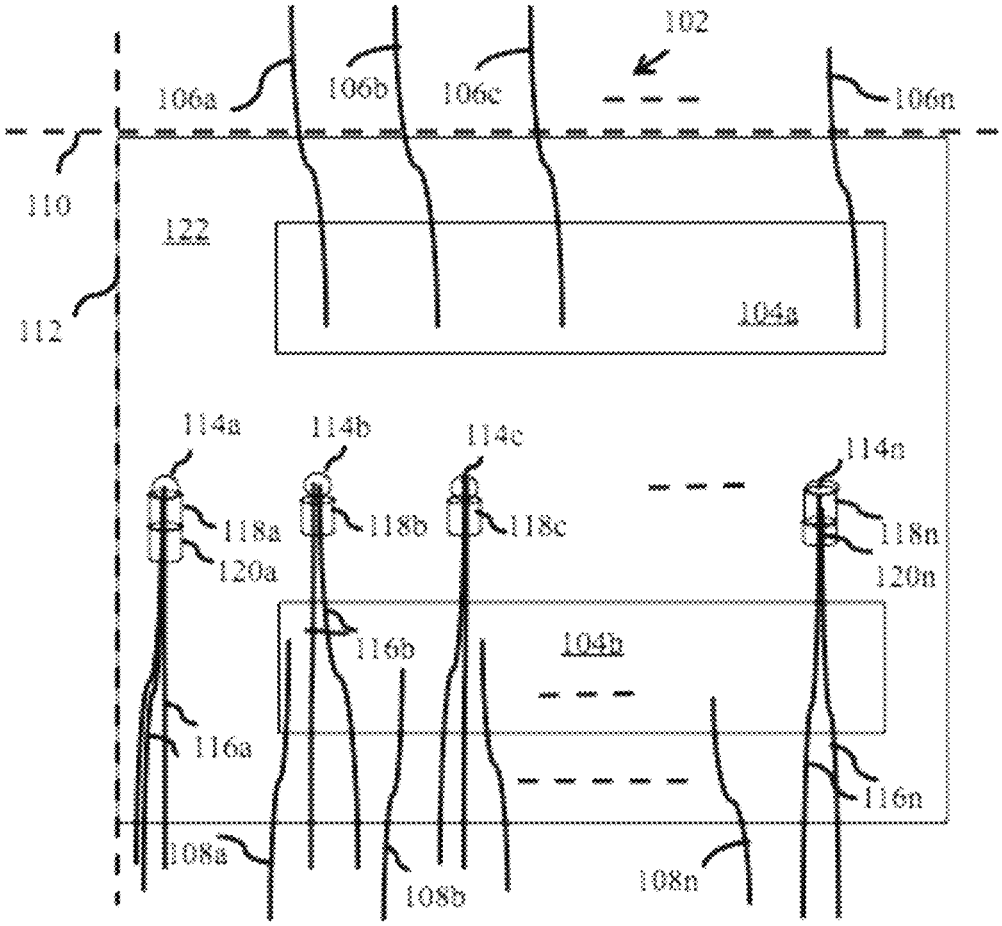
FIG. 1 illustrates a front open view of a hair extension weft anchored on a surface, according to an embodiment herein.

Although the specific features of the embodiments herein are shown in some drawings and not in others. This is done for convenience only as each feature may be combined with any or all of the other features in accordance with the embodiments herein.

DETAILED DESCRIPTION OF THE EMBODIMENTS HEREIN

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The embodiments herein disclose a hair extension weft that includes a polyurethane strip extending along a longitudinal axis and comprising a first longitudinal edge, a second opposing longitudinal edge, a first transverse edge extending between first ends of the first and second longitudinal edges and a second transverse edge, opposite the first transverse edge and extending between second ends of the first and second longitudinal edges, wherein the longitudinal axis divides the polyurethane strip into equal top and bottom halves, the polyurethane strip encasing a plurality of meshes that are arranged along the longitudinal direction of the strip, wherein a first rectangular mesh is secured to the top half of the polyurethane strip and a second rectangular mesh is secured to the bottom half of the polyurethane strip. Each mesh is configured to have a plurality of extension hairs attached thereto such that the extension hairs of the first rectangular mesh extend toward and beyond the first longitudinal edge of the polyurethane strip and the extension hairs of the second rectangular mesh extend toward and beyond the second longitudinal edge of the polyurethane strip. Further, the hair extension weft includes a plurality of apertures arranged between the pluralities of meshes provided along the longitudinal direction of the strip. Each aperture is configured to receive a plurality of hairs clamped to a surface. The plurality of hairs is clamped using a plurality of microbeads to anchor the hair extension weft to the surface.

According to an embodiment herein, the surface is a human scalp of a person, and the plurality of hairs is a plurality of natural hairs existing on the human scalp.

According to an embodiment herein, the plurality of contiguous hairs is attached to the each mesh by a ventilation process or by hand knotting process.

According to an embodiment herein, the plurality of contiguous hairs comprises a natural human hair or synthetic hair.

According to an embodiment herein, the plurality of microbeads is arranged along the longitudinal direction of the strip. Each microbead comprises a hole configured to receive the plurality of hairs extending from each aperture. Each microbead is clamped onto the plurality of hairs. Each microbead is clamped by using a plyer device.

According to an embodiment herein, the hair extension weft further includes a plurality of anchors arranged along the longitudinal direction at a plurality of strategic locations. Wherein an anchor is configured to receive a plurality of hairs extending from a microbead and is arranged below the microbead onto the plurality of hairs extending from the microbead to provide support to the microbead and the plurality of hairs. The anchors are heated with a heating device.

According to an embodiment herein, the plurality of strategic locations include a plurality of areas on the surface and wherein the plurality of areas are subjected to abrasive use.

According to an embodiment herein, a strategic location is a side of a human scalp. The strategic location is one of an area existing on a side of a human scalp and an area at the back of the human scalp that is subjected to a greater styling than an area existing in a remaining portion of the human scalp.

According to an embodiment herein, the plurality of microbeads is made of an aluminum and is covered with a layer of silicone material, and the silicone lining is provided at the inner surface of the central hole in the microbead.

According to an embodiment herein, the plurality of anchors is any one of a plurality of plastic shrinkie tubes, a plurality of keratin beads and a plurality of utip keratin pieces. According to an embodiment herein, the plurality of anchors is ismade of keratin and melt.

According to an embodiment herein, the anchor is clamped by a process of heating with a heating device.

According to an embodiment herein, the plurality of meshes is two, and wherein each mesh is of any rectangular shape of any size. According to an embodiment herein, each mesh is a rectangular mesh. According to an embodiment herein, each mesh has a width of one inch and a length of 5, 10 and 12 inches. Each mesh is provided at a preset distance from a longitudinal edge of the polyurethane strip, and from a transverse edge of the polyurethane strip. Each mesh is separated from the adjacent mesh by a preset distance.

According to an embodiment herein, a method of integrating a hair extension weft on a human scalp is disclosed. The method includes clipping the hair extension weft to the human scalp, and wherein the hair extension weft includes a polyurethane strip encasing a plurality of meshes arranged in a longitudinal direction of the strip. Each mesh is configured to have a plurality of contiguous hairs attached in a transverse orientation, and a plurality of apertures is arranged in the longitudinal direction between the plurality of meshes. Each aperture is configured to receive a plurality of hairs from the human scalp. Further, the method includes pulling the plurality of human hairs through each aperture by using a needle placed under each aperture of the hair extension weft, and clamping a micro bead to the plurality of hairs pulled through each aperture to anchor the hair extension weft to the human scalp.

According to an embodiment herein, the microbead is clamped onto the plurality of hairs by using a plyer device.

According to an embodiment herein, the method further includes clamping an anchor onto a plurality of hairs extending from a microbead located at a strategic location along the longitudinal direction of the hair extension weft to provide support to the microbead and the plurality of hairs.

According to an embodiment herein, the strategic location is an area on the human scalp that is subjected to abrasive use.

According to an embodiment herein, the plurality of microbeads is made of an aluminum material and is covered with a layer of silicone material and the silicone lining is provided at the inner surface of the central hole in the microbead.

According to an embodiment herein, the anchor is any one of a plurality of plastic shrinkie tubes, a plurality of keratin beads and a plurality of utip keratin pieces.

According to an embodiment herein, the plurality of contiguous hairs is attached to the each mesh by any one of a ventilation process and hand knotting process.

According to an embodiment herein, the plurality of contiguous hairs comprises any one of a natural human hair and synthetic hair.

FIG. 1 illustrates a front open view 100 of a hair extension weft 102 anchored on a surface, according to an embodiment herein. In an example embodiment, the surface is a human scalp of a person, and the hair extension weft 102 is anchored to improve an overall hair volume on the human scalp of the person.

The hair extension weft 102 includes a polyurethane strip 124 extending along a longitudinal axis and comprising a first longitudinal edge, a second opposing longitudinal edge, a first transverse edge extending between first ends of the first and second longitudinal edges and a second transverse edge, opposite the first transverse edge and extending between second ends of the first and second longitudinal edges, wherein the longitudinal axis divides the polyurethane strip into equal top and bottom halves. The polyurethane strip encloses a plurality of rectangular meshes, for example a first rectangular mesh 104*a*, and a second rectangular mesh 104*b*, and a plurality of apertures 114*a-n*. Each of the first and second rectangular meshes comprising a top edge, a bottom edge, and first and second lateral edges. A first gap is disposed between the first longitudinal edge of the polyurethane strip and a top edge of the first rectangular mesh, a second gap is disposed between the first transverse edge of the polyurethane strip and a first lateral edge of the first rectangular mesh, and a third gap disposed between the second transverse edge of the polyurethane strip and a second lateral edge of the first rectangular mesh. The second rectangular mesh is secured to the polyurethane strip, parallel to the first rectangular mesh and a fourth gap disposed between the second longitudinal edge of the polyurethane strip and a bottom edge of the second rectangular mesh, a fifth gap disposed between the first transverse edge of the polyurethane strip and a first lateral edge of the second rectangular mesh, and a sixth gap disposed between the second transverse edge of the polyurethane strip and a second lateral edge of the second rectangular mesh; and a seventh gap disposed between a bottom edge of the first rectangular mesh and a top edge of the second rectangular mesh. The plurality of meshes 104*a*, 104*b* are fabricated into the polyurethane strip 102 in a longitudinal direction 110. Each mesh has a plurality of extension hairs attached in a transverse orientation 112. For example, the mesh 104*a* has a plurality of extension hairs 106*a-n* attached in the transverse orientation 112. Similarly the mesh 104*b* has a plurality of extension hairs 108*a-n* in the transverse orientation 112. The plurality of extension hairs 106*a-n* can be attached to the mesh 104*a* by a ventilation process or by hand knotting. Further, the plurality of extension hairs, for example 106*a-n* and 108*a-n*, can be composed of natural human hair, or synthetic hair.

Further, in an embodiment, the plurality of apertures 114*a-n* can be fabricated along the longitudinal direction 110 between the plurality of meshes 104*a* and 104*b*. Each aperture can be configured to receive a plurality of hairs extending from a surface. For example, the aperture 114*a* receives a plurality of hairs 120*a* from the surface. Further, the plurality of hairs 120*a* is clamped, to anchor the hair extension weft 102 to the surface.

Figure 2A:
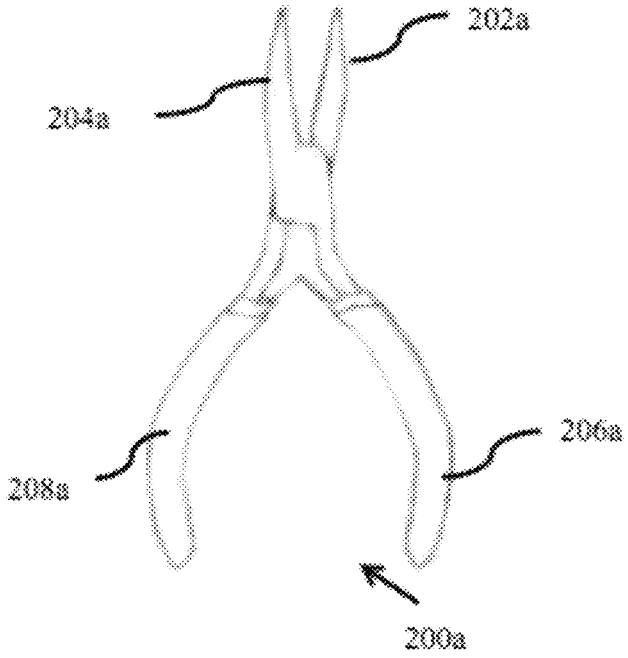
FIG. 2A illustrates a front view of a plyer device used for clamping a microbead onto a plurality of hairs used for anchoring a hair extension weft to a surface, according to an embodiment herein.
Figure 2B:
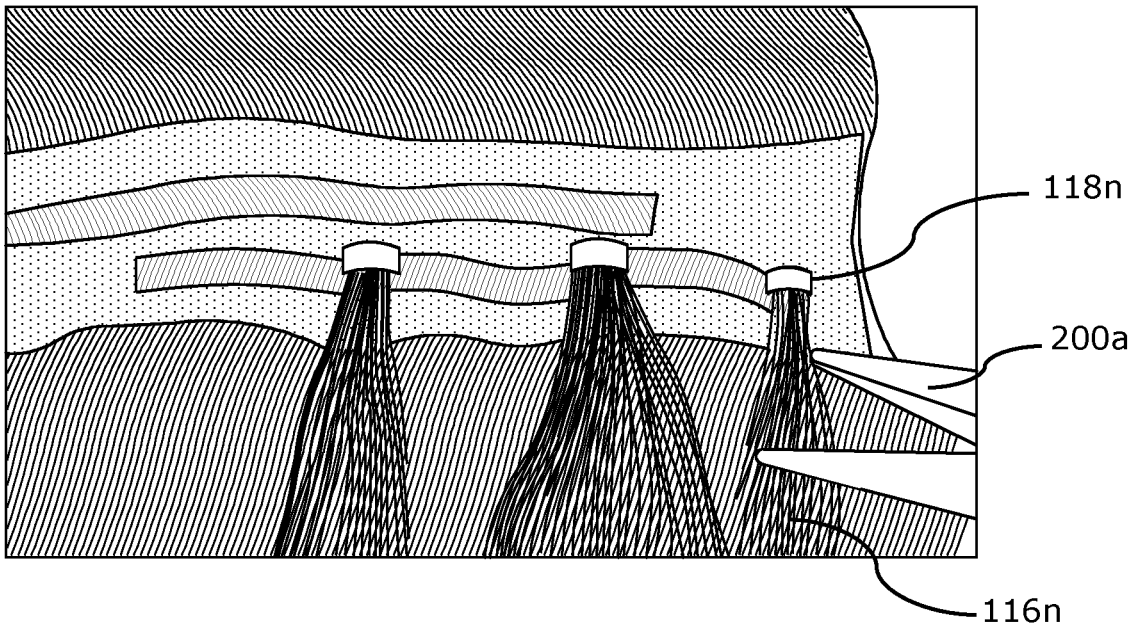
FIG. 2B illustrates a front view of a microbead clamped to a plurality of hairs for anchoring the hair extension weft the plyer device, according to an embodiment herein.
Figure 2C:
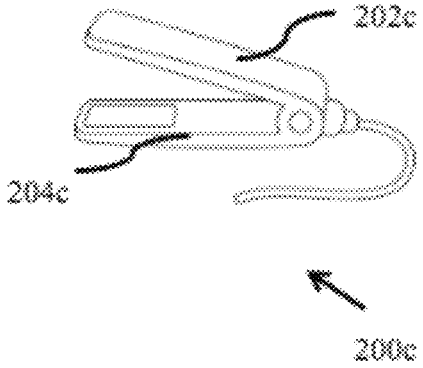
FIG. 2C illustrates a perspective view of a heating device used for heating and clamping an anchor onto a plurality of hairs used for anchoring a hair extension weft to a surface, according to an embodiment herein.
Figure 2D:
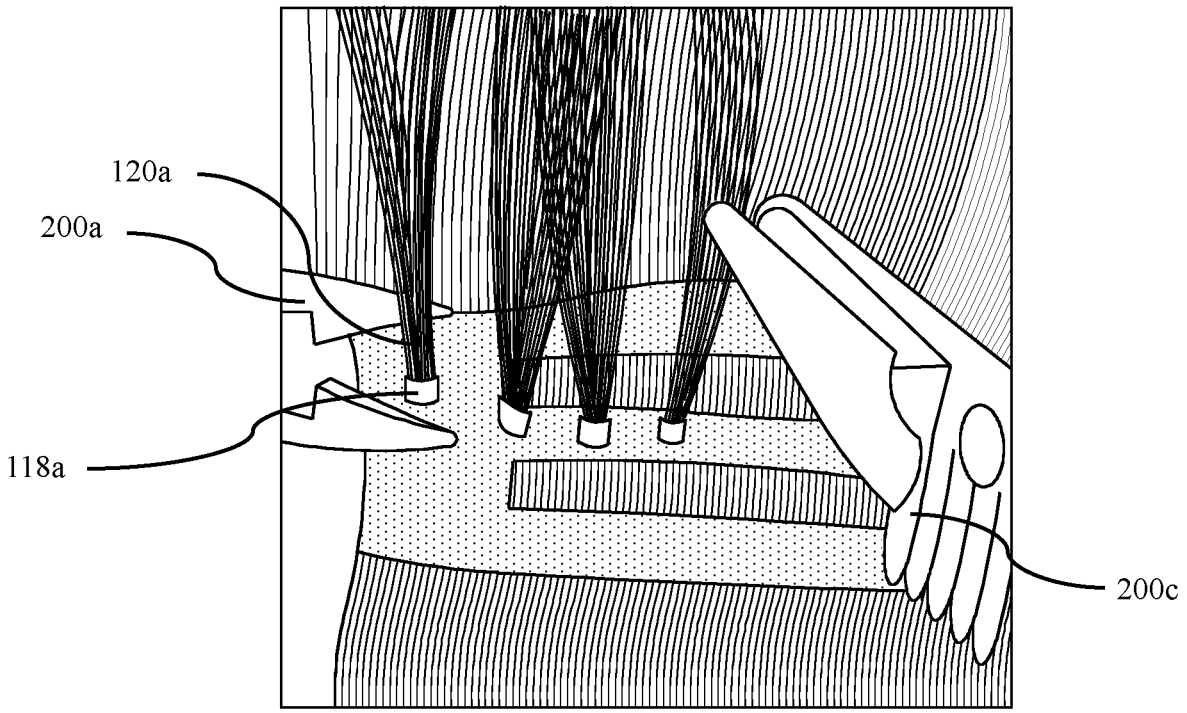
FIG. 2D illustrates a front view of a weft with the heating device used for heating and clamping an anchor to a plurality of hairs for anchoring the hair extension weft, according to an embodiment herein.
Figure 2E:
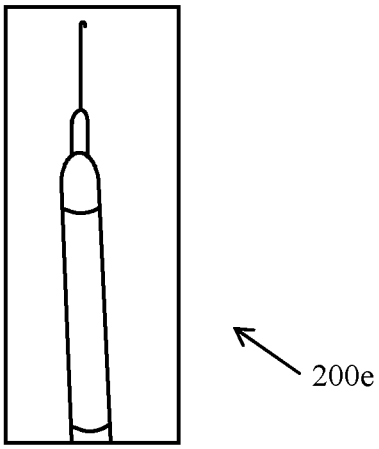
FIG. 2E illustrates a front view of a needle shaped tool used for pulling a plurality of hairs from an aperture of the hair extension weft, according to an embodiment.

Further, the hair extension weft includes a plurality of microbeads 118*a-n* arranged along the longitudinal direction 110. Each microbead includes a hole greater in diameter than each aperture to receive the plurality of hairs extending from each aperture. For example, microbead 118*a* receives the plurality of hairs 116*a* extending from the aperture 114*a*. In an embodiment, the plurality of hairs 116*a* is pulled through the aperture 114*a* using a needle shaped tool 200*e* (as shown in FIG. 2E) that is placed under the aperture 114*a*. Upon receiving the plurality of hairs, the each microbead is clamped onto the plurality of hairs using a plyer device 200*a* (as shown in FIG. 2A). FIG. 2A illustrates the plyer device 200*a* having a first clamping part 202*a* and a second clamping part 204*a* between which the plurality of hairs are clamped using force exerted on the handle bars 206*a* and 208*a*. Upon clamping the each microbead to the plurality of hairs extending from each aperture the plurality of hairs are able to hold the hair extension weft 102 against the surface. As the each microbead has a silicone inner lining, upon clamping no damage is caused to the hair. In an example embodiment, the plurality of microbeads 118*a-n* is composed of a silicone material. FIG. 2B illustrates use of the plyer device 200*a* in clamping the microbead 118*n* onto the plurality of hairs 116*a*.

Further, a plurality of anchors 120*a-n* are arranged along the longitudinal direction 110 at a plurality of strategic locations, wherein an anchor is configured to receive a plurality of hairs extending from a microbead and is clamped below the microbead onto the plurality of hairs extending from the microbead to provide support to the microbead and the plurality of hairs.

In an embodiment, anchor 120*a* is shown to be clamped below the microbead 118*a* onto the plurality of hairs 116*a* to provide additional support to the microbead 118*a* and the plurality of hairs 116*a*. In an embodiment, the plurality of anchors 120*a-n* is a plurality of plastic shrinkie tubes, a plurality of keratin beads or a plurality of utip keratin pieces. The plurality of anchors 120*a-n* may be clamped by a process of heating using a heating device 200*c*, as shown in FIG. 2C. FIG. 2C depicts the heating device 200*c* that includes two plates 202*c* and 204*c*. In an embodiment, as shown in FIG. 2D, the anchor 120*a* is held between the two plates 202*c* and 204*c* and heat generated between the two plates 202*c* and 204*c* is used to shrink and adhere the anchor 120*a* to the plurality of hairs 116*a*. The heating device 200 can be battery operated or can be operated by electrical power.

Although two anchors 120*a* and 120*n* are shown in FIG. 1, it is understood that more than two anchors can be used to anchor the hair extension weft 102. Typically, the plurality of strategic locations comprise a plurality of areas on the surface that are subjected to abrasive use. In an embodiment, where the surface is a human scalp of a person a strategic location is an area existing on a side of the human scalp or an area at the back of the human scalp that is subjected to a greater styling than an area existing in a remaining portion of the human scalp. Hence the additional support provided by the plurality of anchors 120*a-n* prevent the hair extension weft 102 from wearing off easily, thereby increasing a longevity of the hair extension weft 102 on the surface by three to four months.

Figure 3:
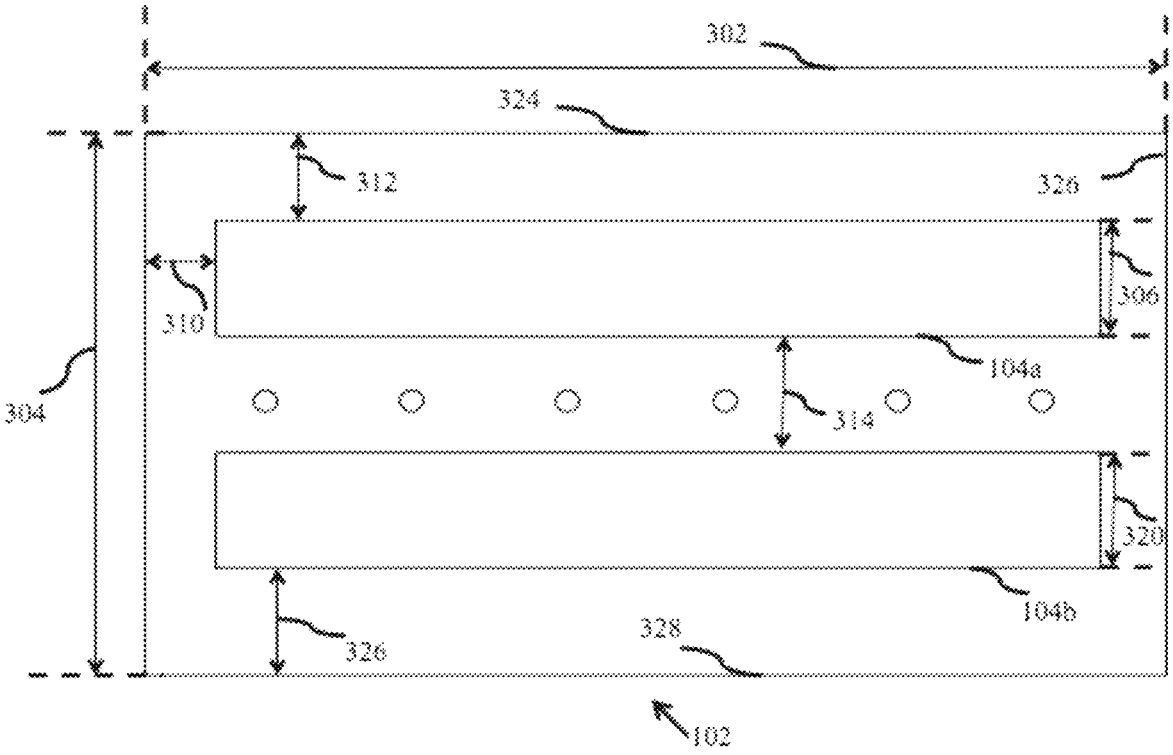
FIG. 3 illustrates a front view of hair extension weft including a plurality of dimensional details, according to an embodiment.

In an embodiment, the hair extension weft 102 may include two rectangular meshes 104*a* and 104*b* as shown FIG. 3. FIG. 3 illustrates a front view of the hair extension weft 102 including dimensional details. For example, for the polyurethane strip 124 having a length 302 of ten inches and a width 304 of one inch, the rectangular mesh 104*a* may have a width 306 of a half-centimeter and a length 308 of eight inches. Further, the mesh 104*a* may be fabricated such that the first gap is at a distance 312 of a half-centimeter from a longitudinal edge 324 of the polyurethane strip 124, and the second dap is a distance 310 of one inch from a transverse edge 326. Further, the rectangular mesh 104*a* is fabricated such that the seventh gap is at distance 314 of a half-centimeter from the mesh 104*b*. The rectangular mesh 104*b* has similar dimensions as the rectangular mesh 104*a*. The rectangular mesh 104*b* is secured to the polyurethane strip such that the fourth gap is at a distance 326 of a half-centimeter from another longitudinal edge 328 of the hair extension weft 102. Further the plurality of apertures 114*a-n*, may be fabricated at a uniform distance from each other, and disposed within the seventh gap, along the longitudinal axis of the polyurethane strip. Typically the haft extension weft 102 is folded where the plurality of apertures 114*a-n* are present and along the longitudinal axis 110, thereby covering knots of the plurality of hafts 116*a-n* present at the plurality of microbeads 118*a-n* and the plurality of anchors 120*a-n*. The hair extension weft 102 is attached using the plurality of hairs 116*a-n* on a surface that is covered due to aforesaid folding and hence as the attachment occurs due to pulling of the plurality of hafts 116*a-n*, the attachment of the hair extension weft 102 is practically invisible.

Figure 4:
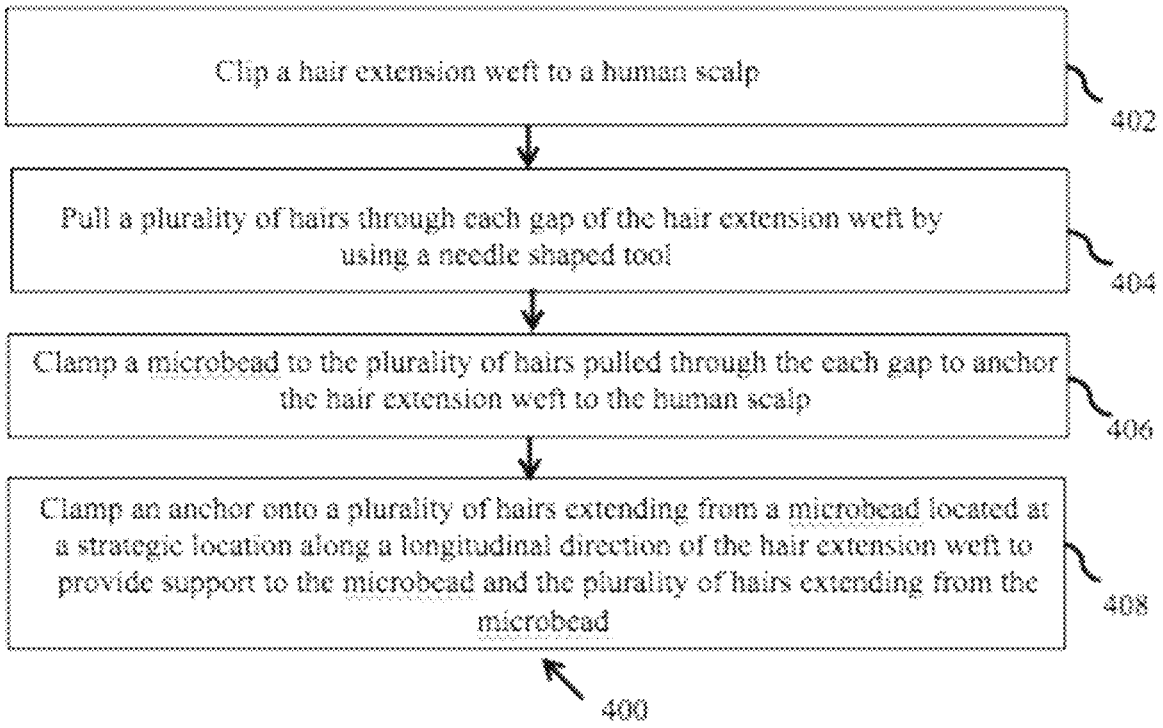
FIG. 4 illustrates a flowchart explaining a method for integrating a hair extension weft, according to an embodiment.

FIG. 4 illustrates a flow chart explaining a method to integrate a hair extension weft on a human scalp. At 402, the haft extension weft is clipped to the human scalp. In an embodiment the hair extension weft is cupped using plastic cups temporarily until the integration of the hair extension weft is complete. The haft extension weft may include a polyurethane strip enclosing a plurality of meshes fabricated in a longitudinal direction of the strip, where each mesh may have a plurality of extension hairs attached in a transverse orientation. The hair extension weft may include a plurality of apertures fabricated in the longitudinal direction between the plurality of meshes, where each aperture receives a plurality of hairs from the human scalp.

At 404, the plurality of hairs is pulled through each aperture by using a needle shaped tool placed under each gap of the hair extension weft.

At 406, a microbead is clamped to the plurality of hairs pulled through each aperture to anchor the hair extension weft to the human scalp. As a result a plurality of microbeads is arranged at the plurality of aperture along the longitudinal direction of the haft extension weft. Upon clamping the plurality of microbeads, the hair extension weft is provided necessary support staying integrated with the human scalp. According to an embodiment, the microbead is clamped onto the plurality of hairs by heating the microbead using a heating device. According to an embodiment, the microbead is composed of silicone material or includes a silicone layer on the inner surface that remains in contact with the plurality of hairs. Hence, due to the heat the microbead shrinks and adheres to the plurality of hafts extending from each aperture.

At 408, an anchor is clamped onto a plurality of hairs extending from a microbead located at a strategic location along the longitudinal direction of the hair extension weft to provide support to the microbead and the plurality of hairs. According to an embodiment, the strategic location is an area on the human scalp that is subjected to abrasive use such as excessive styling. For example, a sides of the human scalp is typically subjected to excessive styling which may loosen the microbead and hence the weft. Attaching the anchor at such strategic location would provide additional support and reduce wear and tear caused due to the excessive styling.

The technical advantages envisaged by the disclosed embodiments include air circulation throughout the hair extension weft, which enables fast drying and efficient ventilation. Further, easy flow of water through the hair extension weft ensures efficient cleaning. Ventilation provided by the plurality of meshes prevents shampoo, hair conditioner, hair oils and other hair products from getting stuck within the hair extension weft. As a result, bacterial growth and molding in between the hair extension weft and the plurality of microbeads are avoided. Existence of the plurality of meshes also ensures a light weighted hair extension weft in comparison to a traditional polyurethane coated hair extension weft. Due to the lightweight, less strain is placed on the plurality of hairs of the human scalp that are used for anchoring the hair extension weft. Hence, an overall user experience in terms of maintenance, and wear is improved.

Further, placing of the plurality of anchors below a set of microbeads at strategic places provides additional support to the hair extension weft and prevents slippage that usually occurs with hair growth and excessive styling. Hence, while normal silicone microbeads prevent slippage of the hair extension weft for four to six weeks on an average, use of the plurality of anchors ensures prevention of slippage for an additional three to four months for normally styled hair and three to five weeks for excessively styled hair.

Further, use of a plurality of silicone micro rings as the plurality of microbeads ensures safe use, as silicone beads or silicone micro rings are less abrasive and cannot cut or destroy normal human hair. Similarly, use of a plurality of shrinkie plastic tubes as the plurality of anchors is safe by virtue of noninvasive property of such tubes.

Furthermore, use of disclosed hair extension wefts may enable an increase in a hair volume by a hundred to two hundred percent. In an embodiment, based on a user preference, a density of hair present on the hair extension weft may be customized.

Furthermore, disclosed hair extension weft is practically undetectable. While disclosed hair extension weft is folded in the center and attached using natural hairs pulled through the center, prior art hair extension wefts are typically attached directly either on the top of the scalp or underneath tufts of hair at the bottom of the scalp. The top or underneath attachment is usually seen if the hair moves in a manner that reveals the underlying weft However disclosed hair extension weft is practically undetectable even if the hair moves in aforesaid manner.

The foregoing description of the specific embodiments will so fully reveal the general nature of the embodiments herein that others can, by applying current knowledge, readily modify and/or adapt for various applications such as specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modifications. However, all such modifications are deemed to be within the scope of the claims.

What is claimed is:

1. A hair extension weft comprising:

a polyurethane strip extending along a longitudinal axis and comprising a first longitudinal edge, a second opposing longitudinal edge, a first transverse edge ends of the first and second longitudinal edges, wherein the longitudinal axis divides the polyurethane strip into equal top and bottom halves;

a first rectangular mesh secured to the top half of the polyurethane strip, a first gap disclosed between the first longitudinal edge of the polyurethane strip and a top edge of the first rectangular mesh, a second gap disposed between the first transverse edge of the polyurethane strip and a first lateral edge of the first rectangular mesh, and a third gap disposed between the second transverse edge of the polyurethane strip and a second lateral edge of the first rectangular mesh;

a second rectangular mesh parallel to the first mesh, and secured to the bottom half of the polyurethane strip, a fourth gap disposed between the second longitudinal edge of the polyurethane strip and a bottom edge of the second rectangular mesh, a fifth gap disposed between the first transverse edge of the polyurethane strip and a first lateral edge of the second rectangular mesh, and a sixth gap disposed between the second transverse edge of the polyurethane strip and a second lateral edge of the second rectangular mesh;

a seventh gap disposed between a bottom edge of the first rectangular mesh and a top edge of the second rectangular mesh;

a plurality of apertures uniformly spaced from each other and disposed within the seventh gap, along the longitudinal axis of the polyurethane strip, wherein the plurality of apertures disposed along the longitudinal axis are the only apertures provided on the hair extension weft;

wherein the first, fourth, and seventh gaps are each 0.5 cm, and the second and third gaps are 1 inch;

the first mesh has a length of 8 inches and a height of 0.5 cm and the polyurethane strip has a length of 10 inches and a height of 1 inch; and wherein the first and second rectangular meshes comprise a plurality of extension hairs attached thereto such that the extension hairs of the first rectangular mesh extend toward and beyond the first longitudinal edge and the plurality of extension hairs of the second rectangular mesh extend toward and beyond the second longitudinal edge.

2. A kit comprising:

A hair extension weft comprising:

a polyurethane strip extending along a longitudinal axis and comprising a first extending between first ends of the first and second longitudinal edges and a second transverse edge, opposite the first transverse edge and extending between second ends of the first and second longitudinal edges, wherein the longitudinal axis divides the polyurethane strip into equal top and bottom halves;

a first rectangular mesh secured to the top half of the polyurethane strip, a first gap disposed between the first longitudinal edge of the polyurethane strip and a top edge of the first rectangular mesh, a second gap disposed between the first transverse edge of the polyurethane strip and a first lateral edge of the first rectangular mesh, and a third gap disposed between the second transverse edge of the polyurethane strip and a second lateral edge of the first rectangular mesh;

a second rectangular mesh parallel to the first mesh, and secured to the bottom half of the polyurethane strip, a fourth gap disposed between the second longitudinal edge of the polyurethane strip and a bottom edge of the second rectangular mesh, a fifth cap disposed between the first transverse edge of the polyurethane strip and a first lateral edge of the second rectangular mesh, and a sixth gap disposed between the second transversed edge of the polyurethane strip and a second lateral edge of the second rectangular mesh;

a seventh gap disposed between a bottom edge of the first rectangular mesh and a top edge of the second rectangular mesh;

a plurality of apertures uniformly spaced from each other and disposed within the seventh gap, along the longitudinal axis of the polyurethane strip, wherein the plurality of apertures disposed along the longitudinal axis are the only apertures provided on the hair extension weft;

wherein the first, fourth, and seventh gaps are each 0.5 cm, and the second and third gaps are 1 inch;

the first mesh has a length of 8 inches and a height of 0.5 cm and the polyurethane strip has a length of 10 inches and a height of 1 inch; and wherein the first and second rectangular meshes comprise a plurality of extension hairs attached thereto such that the extension hairs of the first rectangular mesh extend toward and beyond the first longitudinal edge and the plurality of extension hairs of the second rectangular mesh extend toward and beyond the second longitudinal edge; and a plurality of microbeads, wherein each of the plurality of microbeads comprises an inner surface including a lining of silicone; and a plurality of anchors, each anchor of the plurality of anchors being-configured to be clamped under heat.

3. A hair extension weft comprising consisting of:

a polyurethane strip extending along a longitudinal axis and comprising a first longitudinal edge, a second opposing longitudinal edge, a first transverse edge extending between first ends of the first and second longitudinal edges and a second transverse edge, opposite the first transverse edge extending between second ends of the first and second longitudinal edges, wherein the longitudinal axis divides the polyurethane strip into equal top half and a bottom halves half;

a first rectangular mesh arranged in secured to longitudinal direction along the top half of the polyurethane strip, a first gap disposed between the first longitudinal edge of the polyurethane strip and a top edge of the first rectangular mesh, a second gap disposed between the first transverse edge of the polyurethane strip and a first lateral edge of the first rectangular mesh and a third gap disposed between the second transverse edge of the polyurethane strip and a second lateral edge of the first rectangular mesh;

a second rectangular mesh parallel to the first mesh, and arranged in secured to the longitudinal direction along the bottom half of the polyurethane strip, a fourth gap disposed between the second longitudinal edge of the polyurethane strip and a bottom edge of the second rectangular mesh a fifth gap disposed between the first transverse edge of the pol urethane strip and a first lateral edge of the second rectangular mesh and a sixth cap disposed between the second transverse edge of the polyurethane strip and a second lateral edge of the second rectangular mesh; and a seventh gap disposed between a bottom edge of the first rectangular mesh and a top edge of the second rectangular mesh, and wherein the first, fourth, and seventh gap are equal in size, and the second and third gaps are equal in size, and the first, fourth and seventh gaps are different in size than the second and third gaps; and a plurality of apertures uniformly spaced from each other and disposed within the seventh gap, along the longitudinal axis of the polyurethane strip, wherein the plurality of apertures disposed along the longitudinal axis are the only apertures provided on the hair extension weft; and the first and second rectangular meshes comprise a plurality of extension hairs attached thereto such that the extension hairs of the first rectangular mesh extend toward and beyond the first longitudinal edge and the plurality of extension hairs of the second rectangular mesh extend toward and beyond the second longitudinal edge.

4. The hair extension weft of claim 3, wherein the first, fourth, and seventh gaps are each 0.5 cm.

* * * * *